US005689217A

United States Patent [19]

Gu et al.

[11] Patent Number: 5,689,217

[45] Date of Patent: Nov. 18, 1997

[54] DIRECTIONAL COUPLER AND METHOD OF FORMING SAME

[75] Inventors: Wang-Chang Albert Gu, Coral Springs; Feng Niu, Plantation, both of Fla.

[73] Assignee: Motorola, Inc., Schaumburg, Ill.

[21] Appl. No.: 616,138

[22] Filed: Mar. 14, 1996

[51] Int. Cl.[6] ..... H01P 5/18

[52] U.S. Cl. ..... 333/116; 333/238

[58] Field of Search ..... 333/116, 238, 333/246

[56] References Cited

U.S. PATENT DOCUMENTS 5,063,365 11/1991 Cappucci ..... 333/116 X 5,369,379 11/1994 Fujiki ..... 333/116

5,521,563 5/1996 Mazzochette ..... 333/116

*Primary Examiner*—Paul Gensler

*Attorney, Agent, or Firm*—Barbara R. Doutre

[57] ABSTRACT

A multi-layer substrate (500) includes a segmented stripline (602) which is formed of multi-layered segment (514, 522, 516) and is proximately coupled to a second stripline (604) to form a directional coupler. The directional coupler (500) provides similar input and output port impedances while allowing for independent control of the coupling. The overall length of the coupler is held constant while individual lengths of the segments of the segmented stripline (602) and the second stripline (604) are increased and decreased to independently control the coupling while maintaining the similar port impedances.

21 Claims, 10 Drawing Sheets

800

DIRECTIONAL COUPLER AND METHOD OF FORMING SAME

TECHNICAL FIELD

This invention relates in general to directional couplers and more specifically to the characteristic impedance and coupling associated with the design of directional couplers.

BACKGROUND

Directional couplers are used in a number of high frequency applications, including power splitting/combining, signal sampling, filters, and balanced amplifiers. If a directional coupler is not properly terminated, reflected waves travel back from the load to the input or source of the line. These reflected waves cause degradation in the performance of the system. Port impedance and coupling are two important characteristics that need to be considered in the design of a directional coupler so that proper termination can be achieved.

In a conventional broadside-coupled directional coupler, the coupling and matching port impedance can not be independently adjusted. As a result, circuit designers often have to abandon the directional coupler approach and seek other alternative circuit topologies or use an additional matching circuit to complete the design.

An exploded view of a conventional broadside-coupled directional coupler is illustrated in FIG. 1 of the accompanying drawings. Coupler 100 consists of a multi-layer substrate including two striplines 102, 104 proximately coupled in parallel on separate layers 106, 108 between outer surface ground planes 110, 112. Physically speaking, striplines 102, 104 have substantially the same length (l) and width (w) and are separated by a vertical spacing (s). The ground planes 110, 112 are separated by a distance (b) with the striplines 102, 104 being situated at equal distances from the ground planes, (b-s)/2. Coupler 100 can be characterized by a coupling factor (k), electrical length (θ), and matching port impedances ($Z_0$).

FIG. 2 shows a non-exploded cross sectional side view of the coupler 100 of FIG. 1. Mathematically speaking, the design process for a directional coupler involves the parametric adjustment in three-dimensional space of w, s, and b to meet the design goals of both $Z_0$ and k. The electrical length (θ) of the coupler 100 is directly proportional to the physical length (l) of the striplines. The coupling factor (k) and matching port impedance ($Z_0$), however, are complex functions of w, s, and b. Any adjustment of w, s, or b, will inevitably change the values of both $Z_0$ and k.

FIGS. 3 and 4 of the accompanying drawings illustrate exploded views of variations of prior art directional couplers. Coupler 300 shows a meandered stripline variation and coupler 400 shows a spiraled variation.

Directional couplers can also be difficult to design due to the limitations in material preparation and processing. For example, the spacing between the coupled striplines and ground planes can only be incremented or decremented by a fixed distance even with the most advanced fabrication techniques. Furthermore, the smallest width of the striplines is defined by the processing techniques, and unrealistically wide lines have the adverse implication of large package size.

Accordingly, there is a need for an improved directional coupler structure which overcomes the difficulties associated with conventional stripline directional couplers designs.

DETAILED DESCRIPTION OF THE PREFERRED EMBODIMENT

Figure 2:
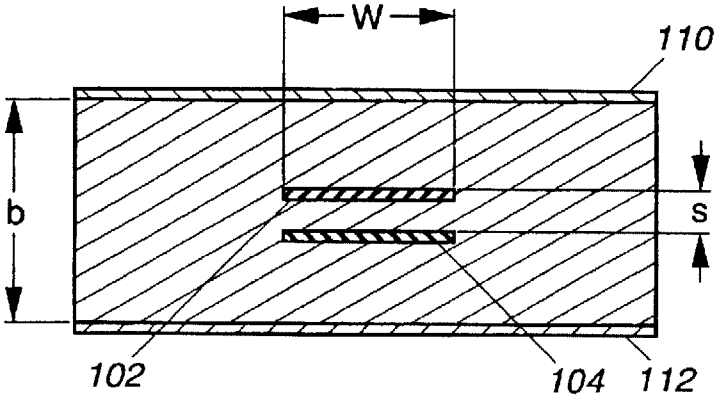
FIG. 2 (PRIOR ART)
FIG. 2 is a cross sectional view of the coupler of FIG. 1.
Figure 1:
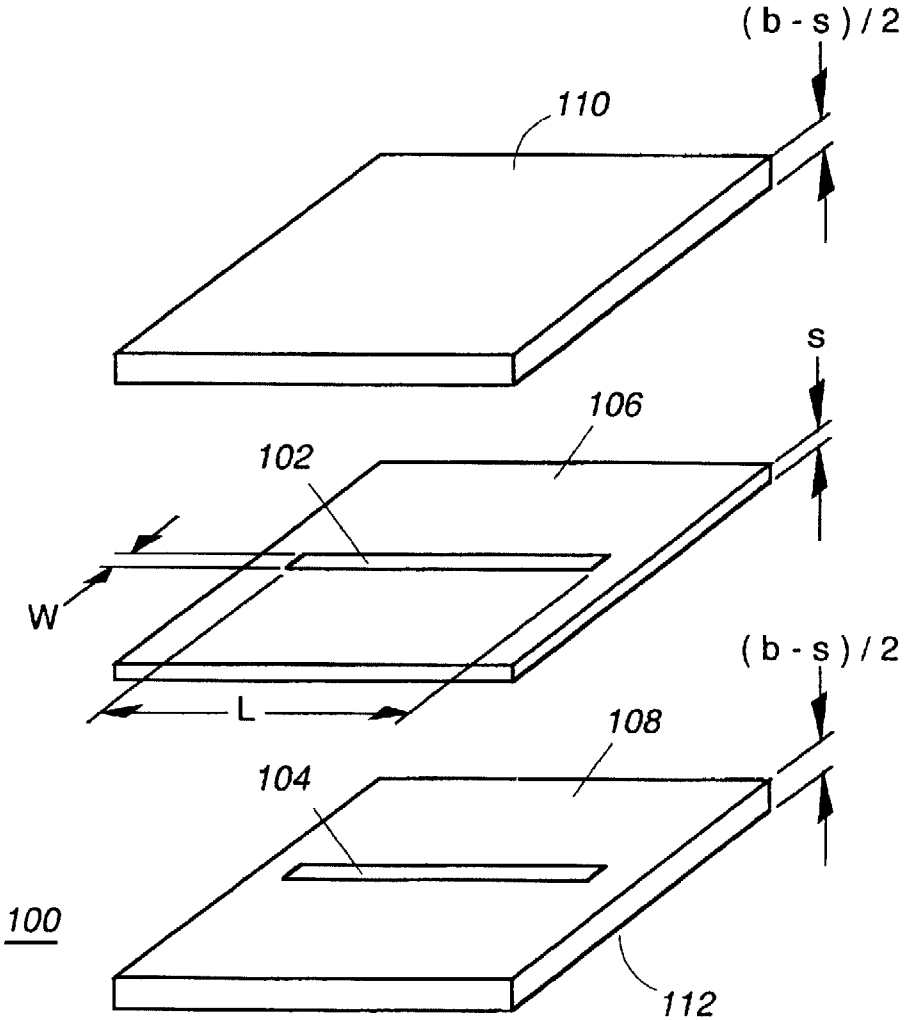
FIG. 1 (PRIOR ART)
FIG. 1 is an exploded view of a prior art directional coupler.
Figure 4:
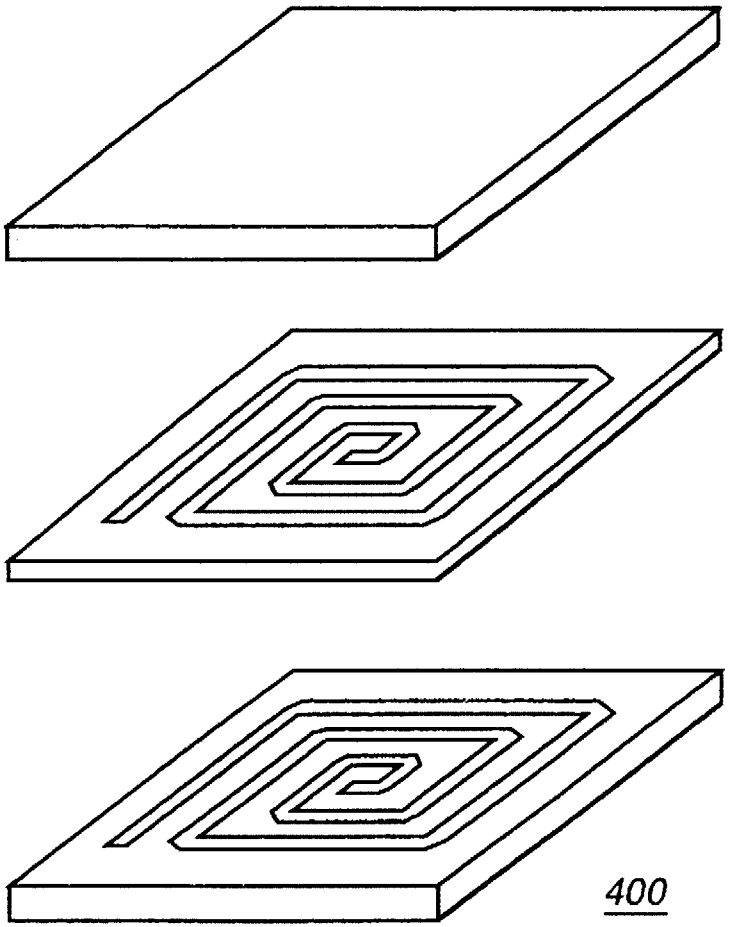
FIG. 4 (PRIOR ART)
FIG. 4 is another prior art spiral variation of a directional coupler.
Figure 3:
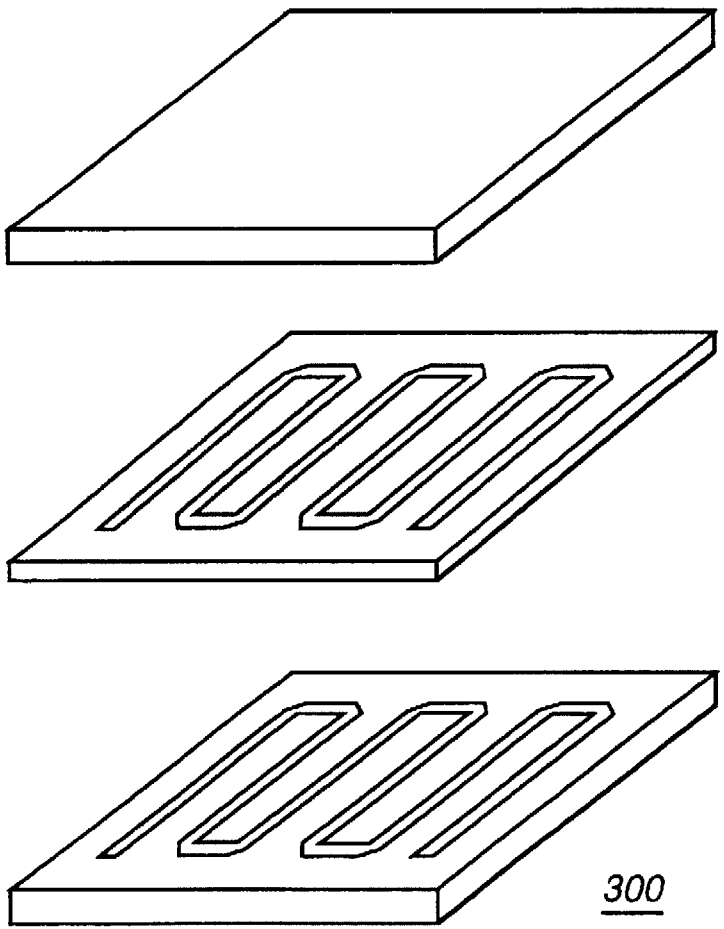
FIG. 3 (PRIOR ART)
FIG. 3 is a prior art meandered variation of a directional coupler.

While the specification concludes with claims defining the features of the invention that are regarded as novel, it is believed that the invention will be better understood from a consideration of the following description in conjunction with the drawing figures, in which like reference numerals are carried forward.

Figure 5:
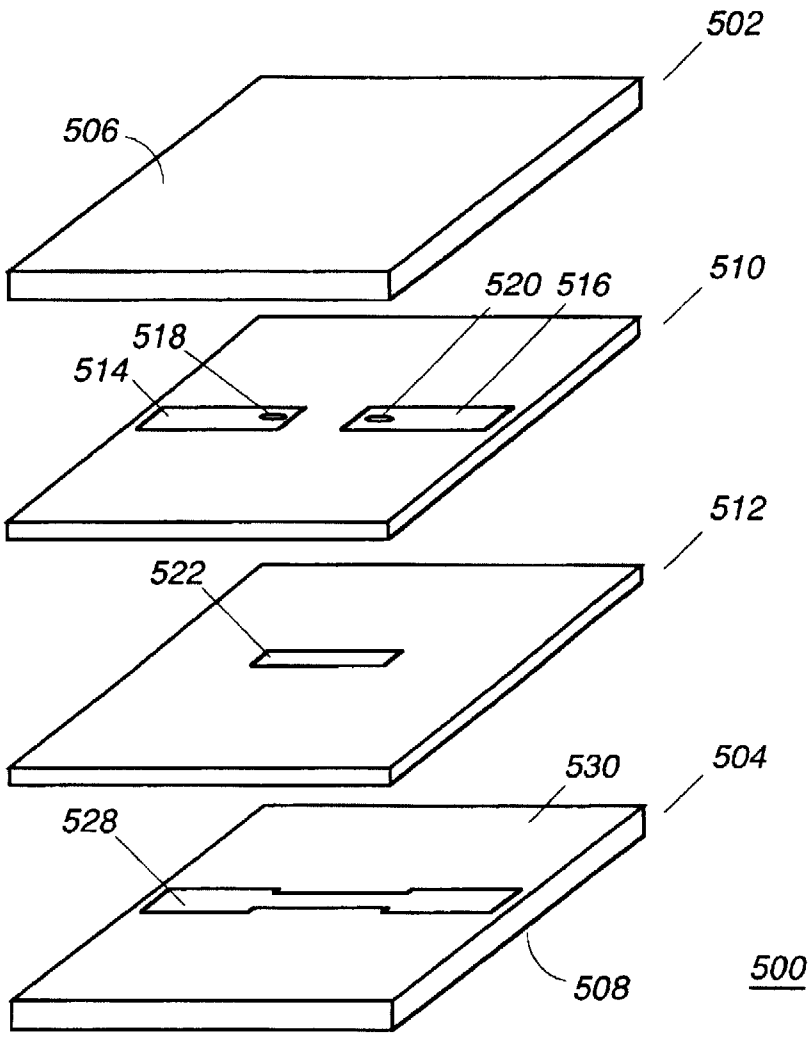
FIG. 5 is an exploded view of a directional coupler having a three layer stripline structure in accordance with the present invention.

Referring now to FIG. 5 there is shown an exploded view of a stripline directional coupler 500 in accordance with the preferred embodiment of the invention. Coupler 500 comprises a multi-layer substrate having top and bottom layers 502, 504 whose outer surfaces 506, 508 are coupled to ground. Outer surfaces 506, 508 provide ground planes to a plurality of stacked inner layers 510, 512 disposed therebetween. In accordance with the preferred embodiment of the invention, coupler 500 further comprises first and second substantially similar striplines 514, 516 disposed on an inner layer, here inner layer 510, each of these striplines including a via, 518, 520. A third stripline 522 is disposed on inner layer 512 and a fourth stripline 528 is disposed on an inner surface 530 of the bottom layer 504. In accordance with the preferred embodiment of the invention, the configuration of the striplines 514, 516, 522, and 528 within the multi-layer substrate 500 provides for substantially equivalent input and output port impedances while allowing for variations in the coupling factor (k).

Figure 6:
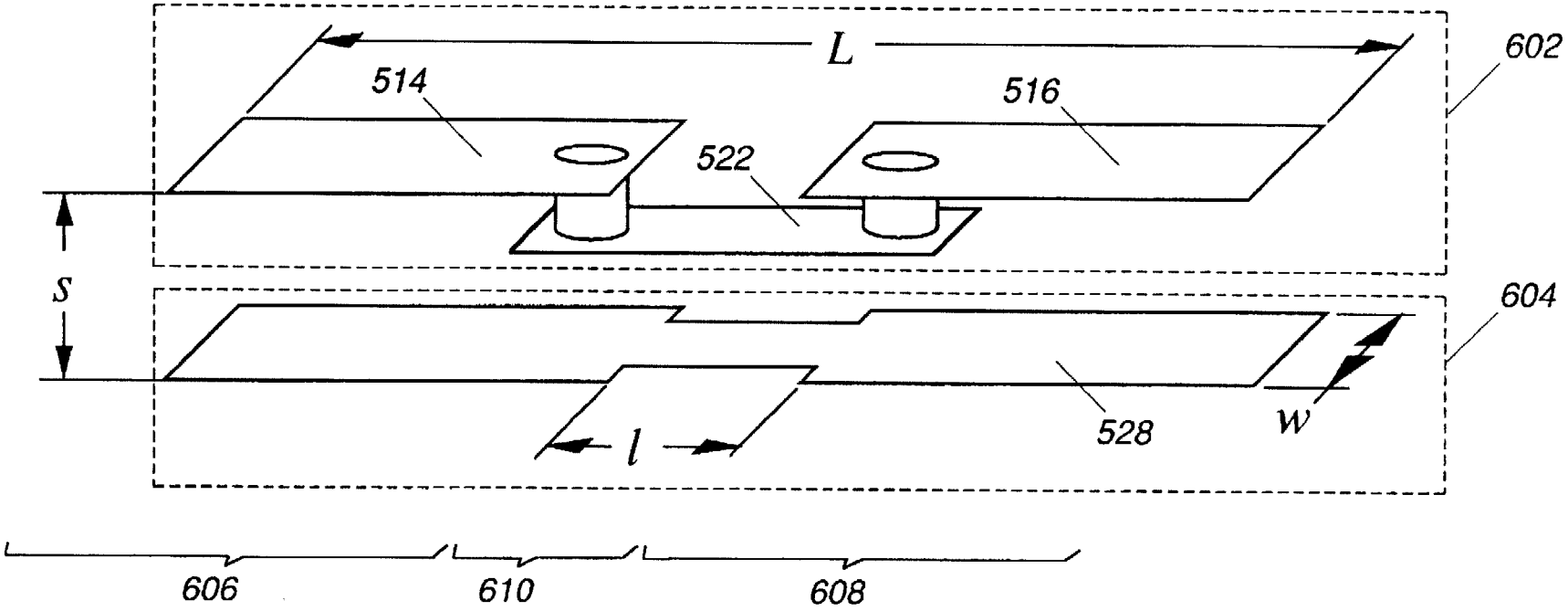
FIG. 6 is a non-exploded view of the three layer stripline structure of FIG. 5 in accordance with the present invention.

FIG. 6 of the accompanying drawings shows a non-exploded view of the stripline portions of coupler 500.

Basically, there are two stripline sections 602, 604 proximately coupled to each other by coupling factor (k). The first section is formed from the first, second and third striplines 514, 516, and 522 interconnected on two different layers of the substrate. This first section 602 will also be referred to as a multi-layer stripline 602 and also as a segmented stripline 602- segmented being defined for the purposes of this application as interconnected striplines on different layers. The second section 604 includes the fourth stripline 528. The segmented stripline 602 of the present invention is thus proximately coupled to the fourth stripline 528 through parallel planes of the multi-layer substrate.

In the preferred embodiment of the invention, a three layer stripline directional coupler structure is formed of the segmented stripline 602 disposed on layers 510 and 512 and the fourth stripline 528 disposed on layer 530. The first and second substantially similar striplines 514, 516 form the outer segments of the segmented stripline 602 while the third stripline 522 provides the inner segment coupled therebetween. Each of the segments 514, 516, and 522 has a predetermined length (1) and width (w), with the first and second segments being substantially similar in dimension.

The second section 604 of coupler 500 comprises the fourth stripline 528. In accordance with the preferred embodiment of the invention, the second section 604 provides a planar mirror image of the first section's segmented stripline 602. The second section 604 proximately couples to the segmented stripline 602 through coupling factor (k). Each segment of the segmented stripline 602 has its respective dimensions mirrored into the plane of the fourth stripline in second section 604.

When used as a power splitter, directional coupler 500 receives an input signal from a source (not shown) through segment 514 while a known load (not shown) terminates the opposite end of stripline 604. The coupler 500 then provides a first coupled output at segment 516 and a second coupled output at the non-loaded end of stripline 604.

The impedance of the stripline directional coupler 500 formed in accordance with the present invention is a function of the width of the segments (w), the vertical spacing between the individual segments and the corresponding planar mirror image, the spacing between ground planes 506, 508, and the dielectric constant of the substrate. In accordance with the preferred embodiment of the invention, these parameters can be selected to provide substantially equivalent input and output port impedances while allowing for adjustments in the coupling factor, k.

The segmented stripline of first section 602 and the planar mirror image of second section 604 can also be thought of as providing three portions to the coupler 500- outer portions 606, 608 and inner portion 610. In the preferred embodiment shown in FIGS. 5 and 6, the coupled striplines in the inner portion 610 are narrower in width than those of the outer portions 606, 608 and the vertical spacing (s) between these inner striplines is only half that of the vertical spacing of the outer portions. Thus, the characteristic impedances ($Z_0$) of the all three portions 606, 608, and 6 10 are substantially equivalent while the coupling factor of the outer portions 606, 608 are substantially equivalent. The coupling factor of inner portion 610, however, is greater than the coupling factor of outer portions 606, 608. Since the impedances of all three portions 606, 608, 610 are substantially equivalent, then increasing the length of the inner portion 610 while decreasing the length of the outer portions 606, 608 by the same amount will increase the overall coupling of the coupler 500 without affecting either the electrical length (θ) or the port impedances of the coupler.

Figure 7:
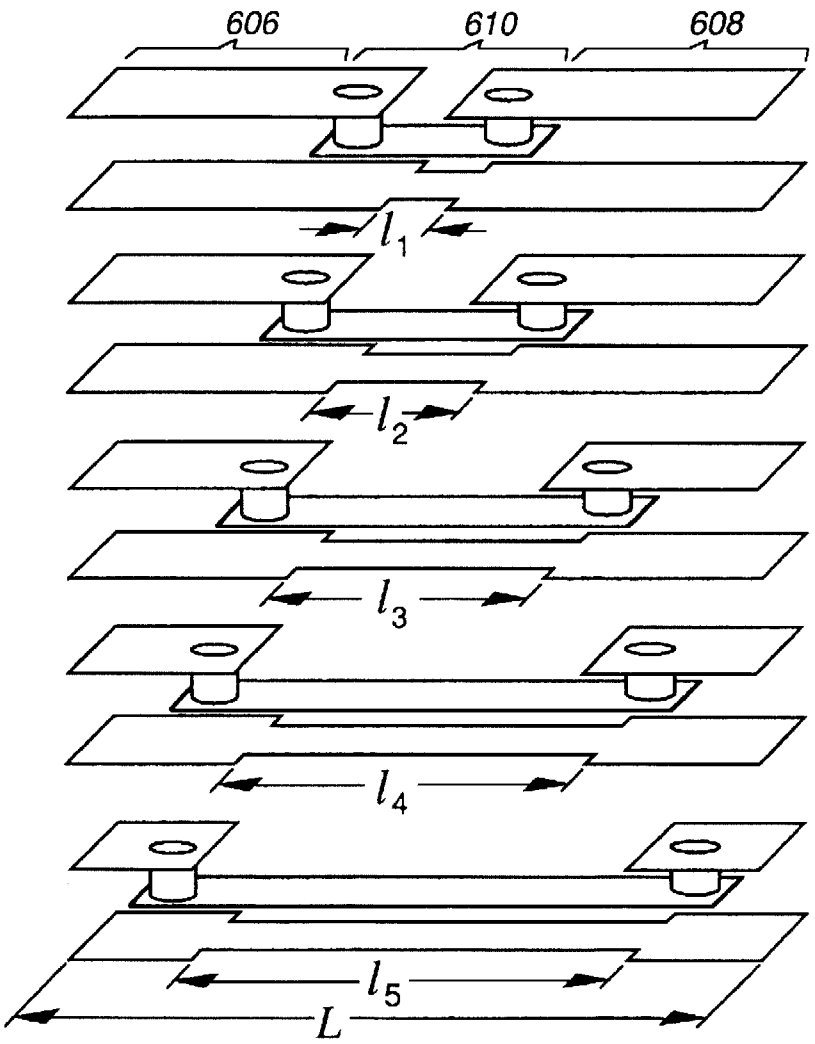
FIG. 7 shows the three layer stripline structure of FIG. 6 with varying fractional lengths.

Referring now to FIG. 7, there is shown the three layer stripline structure of FIG. 6 with the length of its inner portion 610 being varied. Variations in the length (l) of the inner narrower portion 610 are shown while the overall length (L) and all other parameters of the coupler 500 are kept constant. Because the spacing of inner portion 610 is smaller than the spacing of the outer portions 606, 608, increasing the length (l) of the inner portion ($l_5>l_4>l_3>l_2>l_1$) provides for an increase in the overall coupling k ($k_5>k_4>k_3>k_2>k_l$).

Figure 8:
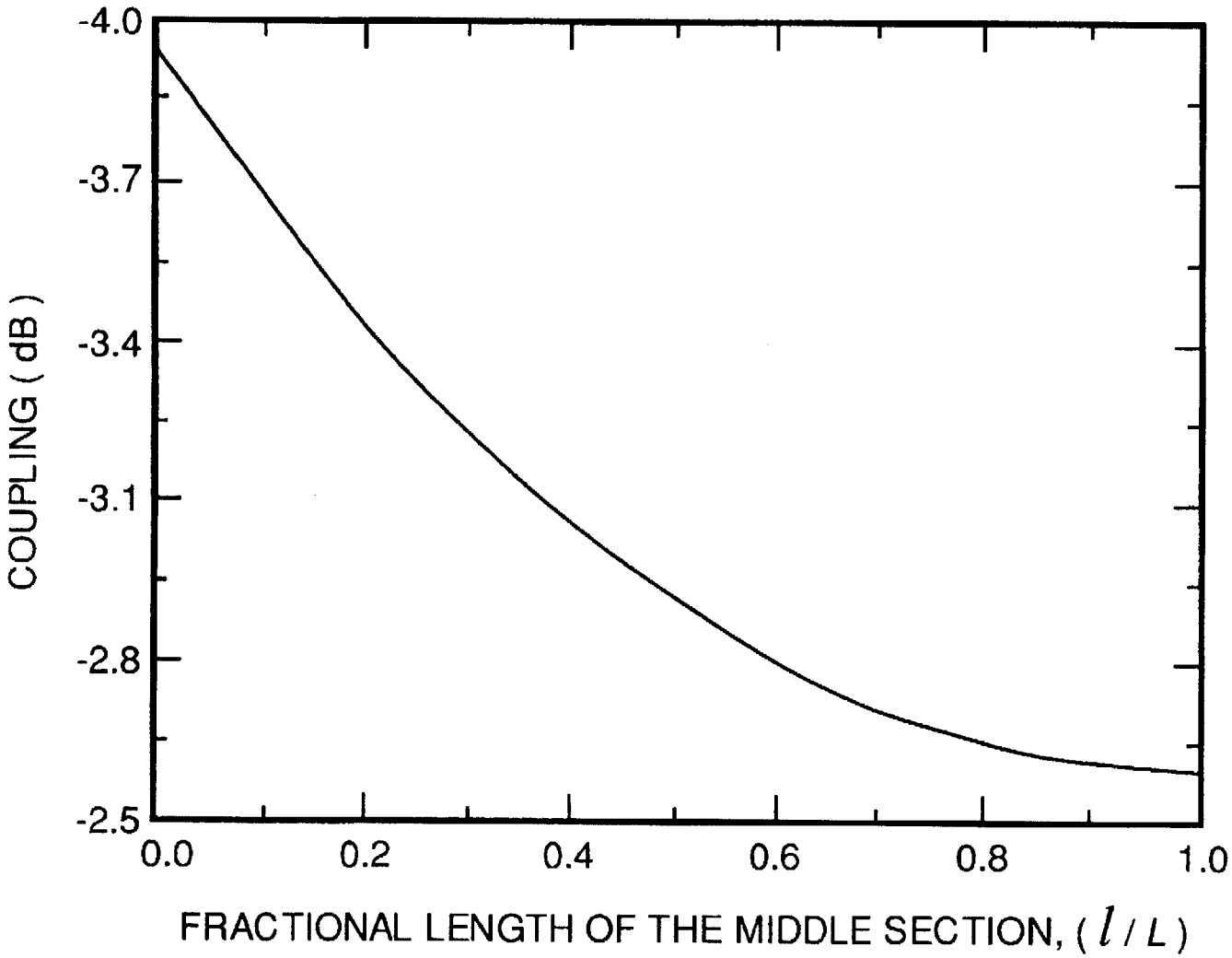
FIG. 8 is a graph of simulated data measuring coupling as a function of fractional length of the directional coupler of FIG. 5.

FIG. 8 is a graph 800 of simulated data measuring coupling in decibels (dB) as a function of fractional length (l/L)of the inner portion 6 10 of coupler 500. The data was simulated using Hewlett Packard's Momentum™ software package and using the following parameters for the coupler:

ground plane spacing=0.167 centimeters (cm)
dielectric constant ($E_r$)=6
total length (L)=3.06 cm
outer portions width (w)=0.031 cm
outer portion spacing (s)=0.015 cm
inner portion width (w)=0.021 cm, and
inner portion spacing (s)=0.008 cm.

The above parameters were held constant to maintain a consistent 50 ohm characteristic impedance and electrical length (θ) of 90 degrees while the length (l) of the inner portion 610 was varied. As shown from the graph 800, the overall coupling increased as the length of the inner portion 610 was increased. One can determine from graph 800 that the commonly used 3-dB coupling(k=3dB) can easily be obtained at a fractional inner portion length of 0.4. Thus, the directional coupler 500 in accordance with the preferred embodiment of the invention can be employed in power splitting and combining applications, such as those frequently employed in high frequency circuits used in portable and mobile radios.

The directional coupler 500 described by the invention enjoys a wide range of applications in high frequency applications for communication devices. Directional coupler 500 is preferably fabricated using a multi-layer ceramic platform to achieve a very high degree of miniaturization which coincides with the ongoing trend in communication hardware. One skilled in the art can also appreciate that the directional coupler described by the invention can be implemented in other platforms such as multi-layer printed circuit board.

Figure 9:
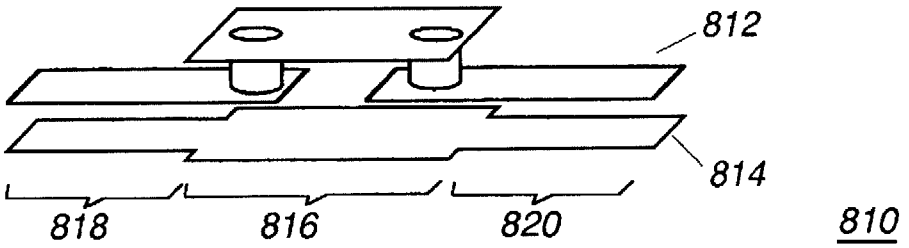
FIG. 9 shows another embodiment of a three layer stripline structure in accordance with the present invention.
Figure 10:
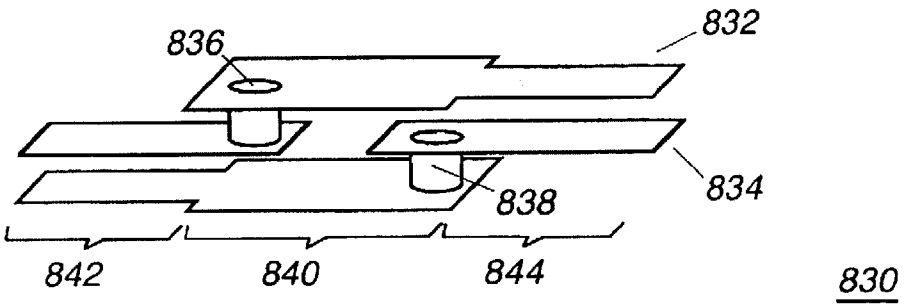
FIG. 10 shows another embodiment of a three layer stripline structure in accordance with the present invention.
Figure 11:
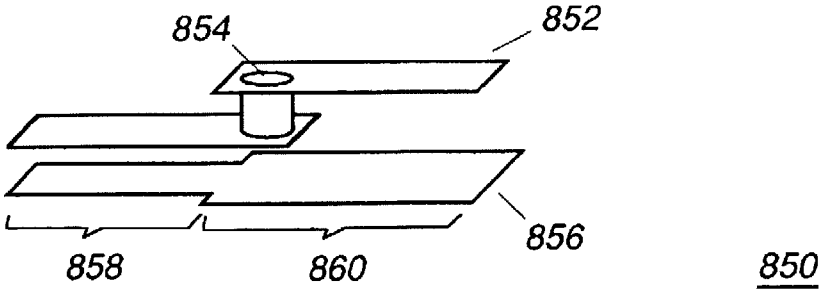
FIG. 11 shows another embodiment of a three layer stripline structure in accordance with the present invention.

Referring now to FIGS. 9, 10, and 11 there are shown other embodiments of the directional coupler constructed using three stripline layers in accordance with the present invention. The overall length, spacing, and width in each of these embodiments are selected to provide for substantially equal input and output port impedances while still allowing for variation in the coupling.

Coupler 810 shows a segmented stripline 812 proximately coupled to a planar mirror image of itself in stripline 814. The coupled striplines of inner portion 816 are wider in width than those of the outer portions 818, 820 while the vertical spacing between these inner striplines is double that of the vertical spacing of the outer portions. Thus, the characteristic impedances of all three portions 816, 818, 820 of coupler 810 are substantially equivalent. An increase in the length of the inner portion 816 (with equal corresponding decreases in the outer portions 818, 820) decreases the coupling of the directional coupler 810. A decrease in the length of the inner portion 816 (with equal corresponding increases in the outer portions 818, 820) increases the coupling of the directional coupler 810.

FIG. 10 shows another variation of a three layer stripline directional coupler 830 in accordance with the present invention. Coupler 830 includes two sections of proximately coupled segmented striplines 832, 834 distributed on three layers. Each segmented section 832, 834 includes a via 836, 838 to interconnect an outer stripline to an inner stripline. The overall shape and dimension of the first section 832 is reflected in the second section 834. In this embodiment, the coupled striplines in the inner portion 840 are wider in width than those of the outer portions 842, 844 while the vertical spacing between these wider striplines is double that of the vertical spacing of the outer portions. Thus, the characteristic impedances of all three portions 840, 842, 844 are substantially similar. As long as the overall length and individual widths and spacings are maintained consistent, the length of the inner portion 840 can be increased (while the length of the outer portions 842, 844 is decreased by a similar amount) to reduce coupling. Increasing the length of the closely coupled outer portions (while decreasing the length of the inner portion) increases the coupling.

FIG. 11 shows another embodiment of a three layer stripline directional coupler 850 in accordance with the present invention. Coupler 850 uses a segmented stripline section 852 having a single interconnecting via 854. The segmented stripline 852 proximately couples to a planar mirror image of itself in stripline 856. This coupler design can be thought of as having first and second portions 858, 860 disposed on three layers. First portion 858 includes the narrow striplines while second portion 860 includes the wider striplines numeral 895. The vertical spacing between the narrower striplines is about half that of the vertical spacing of the wider coupled stripline. Equal and opposite adjustments in the length of one portion versus another maintain a consistent characteristic impedance while adjusting the coupling. Increasing the length of the more tightly coupled striplines will increase the coupling of coupler 850. Increasing the length of the more loosely coupled striplines numeral 860 will decrease the coupling of coupler 850.

While the directional couplers discussed thus far been described in terms of striplines separated on three layers, the directional coupler of the present invention can also be implemented on four layers as well.

Figure 12:
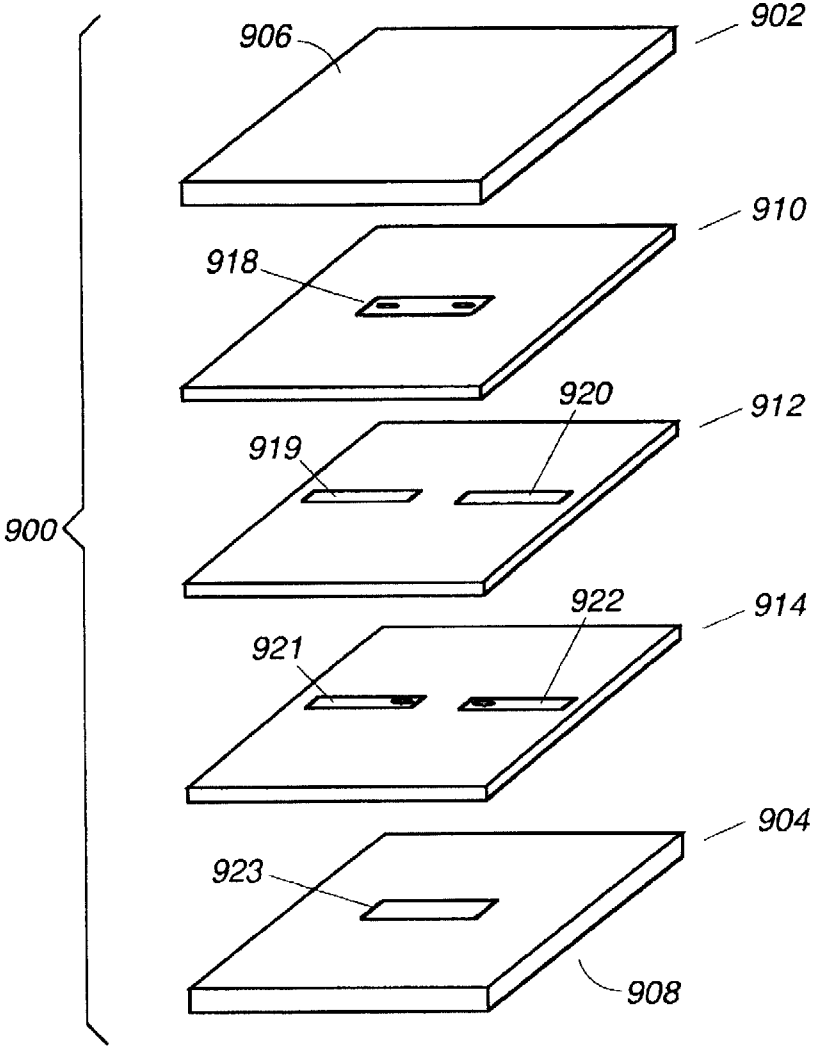
FIG. 12 is an exploded view of a directional coupler having a four layer stripline structure in accordance with the present invention.

Referring now to FIG. 12, there is shown an exploded view of another embodiment of a directional coupler 900 in accordance with the present invention. Coupler 900 is formed of a multi-layer substrate having top and bottom layers 902, 904 providing ground planes, 906, 908. Sandwiched between the ground planes 906, 908 are inner layers, 910, 912, and 914. Stripline 918 is disposed on layer 910 while striplines 919 and 920 are disposed on layer 912. Striplines 921 and 922 are disposed on layer 914 while stripline 923 is disposed on layer 904. When the inner layers are coupled together, the coupler structure shown in FIG. 13 is formed.

Figure 13:
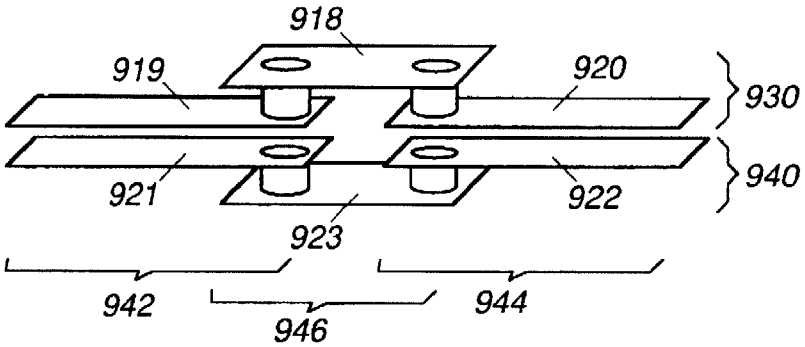
FIG. 13 is a non exploded view of the four layer stripline structure of FIG. 12.

Referring to FIG. 13, striplines 918, 919, and 920 are interconnected on two separate layers to form a first segmented stripline 930. For the sake of simplicity the substrate layers and ground planes have been removed from this view. Striplines 921, 922, and 923 are interconnected on two separate layers to form a second segmented stripline 940. In accordance with the present invention, the first and second segmented striplines 930, 940 are proximately coupled together through parallel planes of the multi-layer substrate.

A direct mirror image of the first segmented stripline 930 is reproduced in the second segmented stripline 940. The two segmented striplines 930, 940 are proximately coupled to each other and form outer portions 942, 944 and inner portion 946. All three portions 942, 944, 946 have substantially equivalent characteristic impedances. The vertical spacing of the wider inner portion consisting of striplines 918, 923 is triple that of the vertical spacing of the outer narrower portions consisting of striplines 919, 921 and striplines 920, 922 to maintain a consistent characteristic impedance. Coupling of directional coupler 900 is increased by reducing the length of the wider inner portion 946 and correspondingly increasing length of the narrower outer portions 942, 944 by an equal amount while maintaining the same overall length. Coupling of directional coupler 900 is decreased by increasing the length of the wider inner portion 946 and correspondingly decreasing the length of the narrower outer portions 942, 944 by an equal amount while maintaining the same overall length.

Figure 14:
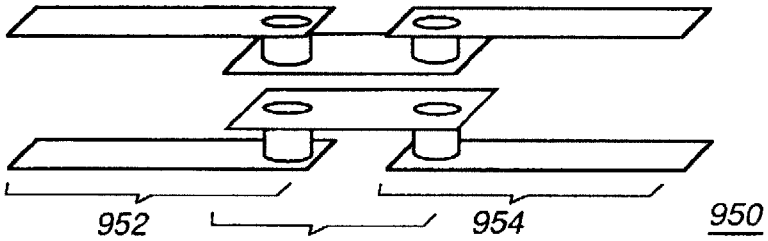
FIG. 14 is another embodiment of a four layer stripline structure in accordance with the present invention.

FIG. 14 shows another four layer variation of a stripline directional coupler 950 (minus the substrate) in accordance with the present invention. Coupler 950 comprises wider outer portions 952, 954 and a narrower inner portion 956. Again, the vertical spacing between coupled striplines, width of striplines, and overall length are designed to provide consistent port impedances. Variations in the length of the inner portion 956 can then be varied to alter the coupling without affecting the characteristic impedance. Here, the coupling would be increased by increasing the length of the inner portion 956 and decreased by decreasing the length of the inner portion while keeping other parameters constant.

Figure 15:
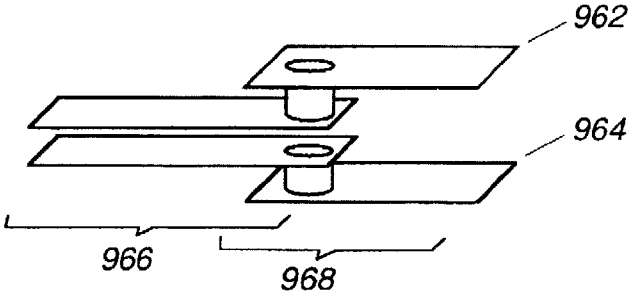
FIG. 15 is another embodiment of a four layer stripline structure in accordance with the present invention.

FIG. 15 shows another four layer variation of a directional coupler 960 (minus the substrate) in accordance with the present invention. Coupler 960 includes two sections of segmented striplines 962, 964 distributed on four layers forming two half portions 966, 968. Equal and opposite changes in the lengths of the striplines in the two portions 966, 968 allows for consistent characteristic impedance while varying the coupling of coupler 960. The spacing of the striplines in portion 966 is selected to be substantially one-third that of the wider coupled striplines in portion 968. Increasing the length of the more tightly coupled striplines in portion 966 will increase the coupling while decreasing this length will decrease the coupling.

By providing a multi-layer substrate and then forming at least one multi-layer segmented stripline within the multi-layer substrate, and then mirror imaging the first multi-layer segmented stripline into either a second multi-layer segmented stripline or as a planar mirror image, one can achieve the directional coupler of the present invention. By proximately coupling the first and second multi-layer segmented striplines and appropriately dimensioning these striplines in the manner previously described to provide a consistent characteristic impedance throughout the coupler, the coupling factor can then be independently varied through a single parameter (segment length) without affecting the characteristic impedance of the directional coupler.

Figure 17:
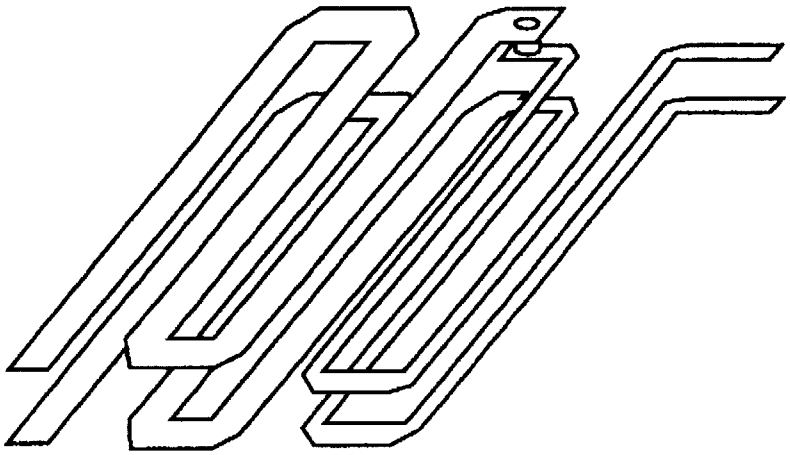
FIG. 17 is a meandered version of a multi-layer stripline structure in accordance with the present invention.
Figure 16:
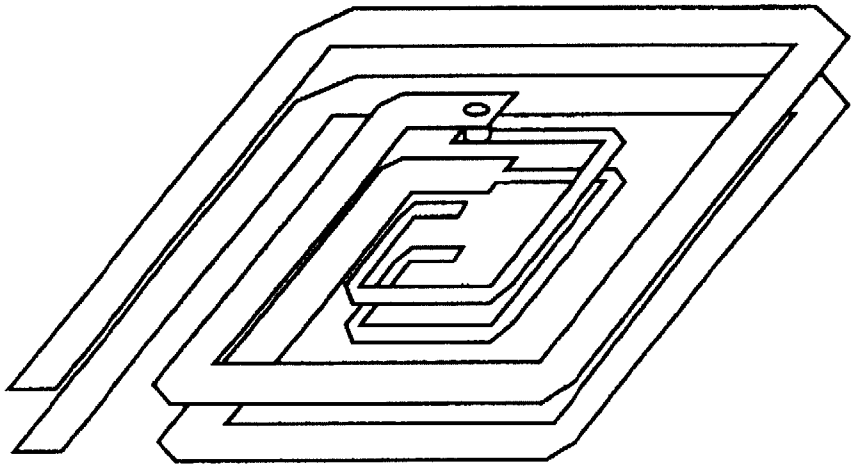
FIG. 16 is a spiraled version of a multi-layer stripline structure in accordance with the present invention.

One skilled in the art can appreciate that the directional coupler described by the invention is not limited by the straight line segmented shapes previously described. The directional coupler of the present invention can be implemented in a variety of configurations including spiral and meandered shapes. FIGS. 16 and 17 show examples of such segmented stripline structures.

FIG. 16 shows the stripline structure (minus the substrate) for a three layer spiral directional coupler in accordance with the present invention. FIG. 17 shows a three layer version of a meandered stripline structure (minus the substrate) for a three layer meandered directional coupler in accordance with the present invention. Both of these variations use a planar mirror image to couple to the segmented stripline, however, four layer dual segmented versions can also be implemented in the manner previously discussed. Simulations of these structures can be performed using available software techniques so as to provide a configuration having substantially equal input and output impedances. The additional layer being used to provide the segmented stripline allows for the coupling factor (k) to be adjusted while maintaining the input and output impedances constant.

Both three layer and four layer segmented stripline embodiments have been provided and variations of each have been discussed. The directional coupler design of the present invention provides the capability of maintaining consistent port impedance with independently adjustable coupling. The difficulties and limitations associated with the design of prior art directional couplers have now been overcome. The coupling factor of a directional coupler being designed in accordance with the present invention can now be adjusted using a single parameter, the segment length, without affecting the matching port impedance of the coupler.

The directional coupler described by the invention can be fabricated using a wide range of technologies to achieve a high degree of miniaturization. The directional coupler described by the invention can be used in high frequency circuits in such applications as power splitting, power combining, signal sampling, phase splitting and phase combining. Once again, the addition of either a third or fourth stripline layer along with proper selected dimensions provides for a directional coupler having substantially equal input and output port impedances with independently adjustable coupling.

What is claimed is:

1. A directional coupler, comprising:

a multi-layer substrate having top and bottom layers with opposing substrate layers therebetween, each of the top and bottom layers having ground planes disposed thereon; and first, second and third striplines disposed between the ground planes, the first and second striplines forming a segmented stripline within the opposing substrate layers and the third stripline being a planar mirror image of the segmented stripline, the third stripline being disposed on another opposing substrate layer.

2. A directional coupler, comprising:

a multi-layer substrate having top and bottom layers with opposing substrate layers therebetween, each of the top and bottom layers having ground planes disposed thereon; and first, second, third, and fourth striplines disposed between the ground planes, the first and second striplines form a first segmented stripline within a first of the opposing substrate layers while the third and fourth striplines form a second segmented stripline within a second of the opposing substrate layers, and the first segmented stripline proximately coupling to the second segmented stripline through the opposing substrate layers.

3. A directional coupler as described in claim 2, the second segmented stripline being a mirror image of the first segmented stripline.

4. A directional coupler, comprising:

a multi-layer substrate providing first and second outer layer ground planes;

first, second, and third striplines disposed between the first and second outer layer ground planes, the first and second striplines forming a segmented stripline proximately coupled to the third stripline through a substrate layer and having coupling factor; and the first, second, and third striplines dimensioned to provide substantially equal input and output port impedances independently of the coupler factor.

5. A directional coupler, comprising:

a substrate having multiple inner layers and top and bottom layers;

first and second ground planes disposed on the top and bottom layers respectively, and disposed between said first and second ground planes are:

a first stripline section having an overall length, comprising:

a first stripline having a predetermined length and width disposed on an inner layer of the substrate;

a second stripline having a predetermined length and width disposed on another inner layer of the substrate and connected to the first stripline;

a second stripline section disposed on yet another inner layer of the substrate, said second stripline section being proximately coupled to the first stripline section and having an overall length substantially equivalent to the overall length of the first stripline section, said second stripline section comprising:

a third stripline providing a corresponding planar mirror image of the first stripline section;

said first and second proximately coupled stripline sections providing substantially equivalent input and output port impedances and an independently controlled coupling factor; and said independently controlled coupling factor being controlled by the lengths of the first and second striplines and the corresponding planar mirror image provided by the third stripline.

6. A directional coupler, as described in claim 5, wherein said first stripline section further comprises:

a fourth stripline connected to the second stripline, said fourth stripline having substantially the same length and width as the first stripline.

7. A directional coupler as described in claim 5, wherein said second stripline section, further comprises:

a fourth stripline connected to the third stripline, said fourth stripline having substantially the same length and width as the first stripline; and the second stripline providing a planar mirror image of the third and fourth striplines.

8. A directional coupler, comprising:

a multi-layer substrate having a top ground plane and a bottom ground plane; and first and second proximately coupled stripline sections located in parallel planes between the top ground plane and the bottom ground plane, the first and second proximately coupled stripline sections providing substantially similar input and output port impedances and having a coupling factor associated therewith, said first and second proximately coupled stripline sections providing an overall length to the directional coupler, at least one of the first and second proximately coupled stripline sections comprising a segmented stripline, each segment of the segmented stripline having a predetermined length and width, each segment's length and width being reflected in the second stripline section, said coupling factor responsive to changes in each segment's length while the input and output port impedances remain substantially similar and the overall length of the directional coupler remains constant.

9. A directional coupler, comprising:

a multi-layer substrate formed of parallel planes, said multi-layer substrate including:

a first segmented stripline;

a second segmented stripline proximately coupled in a parallel plane to the first segmented stripline by a coupling factor (k);

each segment of the first segmented stripline having a substantially similar corresponding segment on the second segmented stripline, and corresponding segments of the first and second segmented striplines having similar lengths and similar widths selected to provide substantially equivalent input and output port impedances to the directional coupler; and said coupling factor responsive to variations in the similar lengths of the corresponding segments while said input and output port impedances remain substantially equivalent.

10. A directional coupler as described in claim 9, wherein the second segmented stripline is a mirror image of the first segmented stripline.

11. A directional coupler as described in claim 9, wherein the second segmented stripline is a planar mirror image of the first segmented stripline.

12. A directional coupler, comprising:

a substrate having parallel planes;

first and second substantially similar segmented striplines disposed within the parallel planes of the substrate and having an overall length, the second segmented stripline being a mirror image of the first segmented stripline, the first segmented stripline having segments being formed of a predetermined length and width, the second segmented stripline having segments being form with similar corresponding lengths and widths to those of the first segmented stripline, the predetermined lengths and widths of the first segmented stripline and the corresponding lengths and widths of the second segmented stripline being selected to provide substantially equivalent input and output port impedances to the directional coupler; and said first and second substantially similar segmented striplines proximately coupled through a coupling factor, said coupling factor being responsive to variations in the predetermined lengths and widths of the first segmented stripline and the corresponding lengths and widths of the second segmented stripline while the input and output port impedances remain substantially equivalent and the overall length remains constant.

13. A method of forming a directional coupler, comprising the steps of:

providing a multi-layer substrate;

providing a first segmented stripline to the multi-layer substrate, each segment of the first segmented stripline being dimensioned of predetermined lengths and widths;

proximately coupling a second segmented stripline to the first segmented stripline in the multi-layer substrate, each segment of the second segmented stripline being dimensioned with substantially similar lengths and widths to those of the first segmented stripline to provide substantially equal input and output port impedances, the first and second proximately coupled segmented striplines having an overall length;

maintaining the overall length of the first and second proximately coupled segmented striplines constant; and independently controlling the coupling factor by varying the lengths of the segments of the first segmented stripline and the substantially similar lengths of the segments of the second segmented stripline.

14. A method of forming a directional coupler as described in claim 13, wherein the second segmented stripline is a mirror image of the first segmented stripline.

15. A method of forming a directional coupler as described in claim 13, wherein the second segmented stripline is a planar mirror image of the first segmented stripline.

16. A directional coupler, comprising:

a substrate having top and bottom layers and multiple layers disposed therebetween;

a ground plane disposed on each of the top and bottom layers;

a first stripline disposed on a first layer of the substrate;

a second stripline disposed on a second layer of the substrate, the second stripline being interconnected to the first stripline;

a third stripline proximately coupled to the first and second interconnected striplines, said third stripline being a planar mirror image of the first and second striplines; and wherein the third stripline proximately coupled to the first and second interconnected striplines provide a consistent characteristic impedance to the directional coupler, and wherein the third stripline is proximately coupled to the first and second interconnected striplines through a coupling factor which is independently controlled of the characteristic impedance.

17. A directional coupler as described in claim 16, wherein the first stripline has a predetermined length and width and the second stripline has a predetermined length and width, and wherein the coupling between the first and second interconnected striplines and the third stripline is controlled by the predetermined lengths of the first and second interconnected striplines and the planar mirror image of the third stripline.

18. A directional coupler, comprising:

first and second striplines disposed on a layer of a multi-layer substrate;

a third stripline disposed on another layer of the multi-layer substrate, said third stripline connected between the first and second striplines to form a segmented stripline; and a fourth stripline proximately coupled to the segmented stripline through a coupling factor (k), the segmented stripline and the fourth stripline being dimensioned to provide substantially equivalent input and output port impedances to the directional coupler independently of the coupling factor.

19. A directional coupler as described in claim 18, wherein the fourth stripline is a planar mirror image of the segmented stripline disposed on a single layer of the multi-layer substrate.

20. A directional coupler as described in claim 18, wherein the fourth stripline is a mirror image of the segmented stripline disposed on multi-layers of the multi-layer substrate.

21. A method of forming a directional coupler, comprising the steps of:

providing a multi-layer substrate having parallel planes;

providing a first multi-layer stripline to the multi-layer substrate, said first multi-layer stripline including individual segments having lengths and widths;

mirror imaging a second multi-layer stripline corresponding to the first multi-layer stripline within the parallel planes, the mirror imaged second multi-layer stripline proximately coupling to the first multi-layer stripline, the first and second multi-layer striplines providing an overall length to the directional coupler;

selecting the lengths and widths of the individual segments of the first multi-layer stripline and the second multi-layer stripline to provide substantially equivalent input and output port impedances; and adjusting the coupling between the first and second multi-layer striplines independently of the input and output port impedances by performing the steps of:

adjusting the lengths of the individual segments of the first multi-layer stripline; and making corresponding adjustments to the second multi-layer stripline while maintaining the overall length of the directional coupler constant.

* * * * *

UNITED STATES PATENT AND TRADEMARK OFFICE

CERTIFICATE OF CORRECTION

PATENT NO. : 5,689,217--

DATED : November 18, 1997--

INVENTOR(S) : Gu, et al.--

It is certified that error appears in the above-identified patent and that said Letters Patent is hereby corrected as shown below:

Title page, in the Abstract on line 2, after multi-layered" and before "(514,522," delete "segment" and insert therefor --segments--.

Column 7, claim 2, line 52, at the end of the line after "striplines" delete "form" and insert therefor -- forming--.

Column 8, claim 4, line 2, after "having" and before "coupling" insert --a --.

Column 9, claim 12, line 35, at the beginning of the line, delete "form" insert therefor --formed--.

Signed and Sealed this

Twenty-ninth Day of September, 1998

*Attest:*

*Attesting Officer*

BRUCE LEHMAN

*Commissioner of Patents and Trademarks*